US010633957B2

(12) United States Patent
Salazar et al.

(10) Patent No.: US 10,633,957 B2
(45) Date of Patent: Apr. 28, 2020

(54) REDUCING SOLVENT RETENTION IN ES-SAGD

(71) Applicant: CONOCOPHILLIPS COMPANY, Houston, TX (US)

(72) Inventors: Arelys Y. Salazar, Houston, TX (US); Tawfik N. Nasr, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/491,517

(22) Filed: Sep. 19, 2014

(65) Prior Publication Data

US 2015/0083413 A1 Mar. 26, 2015

Related U.S. Application Data

(60) Provisional application No. 61/880,581, filed on Sep. 20, 2013.

(51) Int. Cl.
*E21B 43/24* (2006.01)
*E21B 43/30* (2006.01)

(52) U.S. Cl.
CPC ..... *E21B 43/2406* (2013.01); *E21B 43/2408* (2013.01); *E21B 43/30* (2013.01)

(58) Field of Classification Search
CPC .. E21B 43/2408; E21B 43/2406; E21B 43/24; E21B 43/30
USPC ..... 166/400, 401, 272.1, 272.3, 272.4
See application file for complete search history.

(56) References Cited

U.S. PATENT DOCUMENTS 2,862,558 A * 12/1958 Dixon ..... E21B 43/24 166/272.3
4,109,723 A * 8/1978 Widmyer ..... E21B 43/24 166/263
4,127,170 A * 11/1978 Redford ..... E21B 43/16 166/252.1
4,687,058 A * 8/1987 Casad ..... C09K 8/592 166/266
5,685,371 A * 11/1997 Richardson ..... C09K 8/592 166/272.4
6,230,814 B1 * 5/2001 Nasr ..... C09K 8/592 166/263
6,662,872 B2 * 12/2003 Gutek ..... E21B 43/168 166/263
6,708,759 B2 * 3/2004 Leaute ..... E21B 43/24 166/263
8,752,623 B2 * 6/2014 Sirota ..... C09K 8/58 166/267
9,534,483 B2 * 1/2017 Khaledi ..... C09K 8/592
2003/0062159 A1 * 4/2003 Nasr ..... C09K 8/592 166/272.1

(Continued)

OTHER PUBLICATIONS

Nasr, T. N., Golbeck H. and Heck, G.: 2003, "Novel expanding solvent-SAGD process ES-SAGD", Journal of Canadian Petroleum Technology 42(1), 13-16.

(Continued)

*Primary Examiner* — Angela M DiTrani Leff
(74) *Attorney, Agent, or Firm* — Boulware & Valoir

(57) ABSTRACT

Hydrocarbons in a subterranean reservoir are recovered using Expanding Solvent-Steam Assisted Gravity Drainage (ES-SAGD), including recovering hydrocarbons while reducing the solvent retention in the reservoir. Reducing solvent retention improves process economics.

8 Claims, 6 Drawing Sheets

(56) References Cited

U.S. PATENT DOCUMENTS

| | | | | |
|---|---|---|---|---|
| 2008/0017372 | A1* | 1/2008 | Gates | E21B 43/16 166/254.1 |
| 2010/0155062 | A1* | 6/2010 | Boone | C09K 8/58 166/272.3 |
| 2010/0276140 | A1* | 11/2010 | Edmunds | E21B 43/2408 166/272.3 |
| 2012/0312534 | A1* | 12/2012 | Nasr | E21B 43/12 166/272.3 |
| 2012/0325470 | A1* | 12/2012 | Gupta | C09K 8/592 166/272.3 |
| 2014/0144627 | A1 | 5/2014 | Salazar | |
| 2014/0345855 | A1 | 11/2014 | Wilfing | |
| 2014/0345861 | A1 | 11/2014 | Stalder | |

OTHER PUBLICATIONS

Nasr, T. N. and Ayodele, O. R.: 2006, "New hybrid steam-solvent processes for the recovery of heavy oil and bitumen," paper SPE 101717 presented at the SPE Abu Dhaba International Petroleum Exhibition and Conference, Abu Dhabi. Nov. 5-8.

* cited by examiner

REDUCING SOLVENT RETENTION IN ES-SAGD

PRIOR RELATED APPLICATIONS

This application is a non-provisional application which claims benefit under 35 USC § 119(e) to U.S. Provisional Application Ser. No. 61/880,581 filed Sep. 20, 2013, entitled "REDUCING SOLVENT RETENTION IN ES-SAGD."

FIELD OF THE DISCLOSURE

The disclosure generally relates to a method of recovering hydrocarbons in a subterranean reservoir using Expanding Solvent-Steam Assisted Gravity Drainage (ES-SAGD), and more particularly to a method of recovering hydrocarbons while reducing the solvent retention in the reservoir.

BACKGROUND OF THE DISCLOSURE

Many countries in the world have large deposits of oil sands, including the United States, Russia, and various countries in the Middle East. However, the world's largest deposits occur in Canada and Venezuela. Oil sands are a type of unconventional petroleum deposit. The sands contain naturally occurring mixtures of sand, clay, water, and a dense and extremely viscous form of petroleum technically referred to as "bitumen," but which may also be called heavy oil or tar.

The crude bitumen contained in the Canadian oil sands is described as existing in the semi-solid or solid phase in natural deposits. The viscosity of bitumen in a native reservoir can be in excess of 1,000,000 cP. Regardless of the actual viscosity, bitumen in a reservoir does not flow without being stimulated by methods such as the addition of solvent and/or heat. At room temperature, it is much like cold molasses.

Due to their high viscosity, these heavy oils are hard to mobilize, and they generally must be made to flow in order to produce and transport them. Heat is commonly used to lower viscosity and induce flow. One common way to heat bitumen is by injecting steam into the reservoir. Steam Assisted Gravity Drainage (SAGD) is the most extensively used technique for in situ recovery of bitumen resources in the McMurray Formation in the Alberta Oil Sands and other reservoirs containing viscous hydrocarbons. In a typical SAGD process, shown in FIG. 1, two horizontal wells are vertically spaced by 4 to less than 10 meters (m). The production well is located near the bottom of the pay and the steam injection well is located directly above and parallel to the production well. In SAGD, steam is injected continuously into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within the steam vapor and heated bitumen and steam condensate chamber.

Another option to lower oil viscosity is to dilute the viscous oil by injecting a solvent, preferably an organic solvent. As the solvent is dissolved and mixed with the oil, the low viscosity diluted oil can be recovered.

Vapor Extraction (VAPEX) can also be used to extract heavy oil. It is similar to the process of SAGD, but instead of injecting hot steam into the oil reservoir, hydrocarbon solvents are used, and the hydrocarbon solvent is typically captured and recycled. A typical VAPEX process is shown in FIG. 2. Because neither heat, nor water are used in VAPEX, it conserves on energy and water usage, although solvent contributes significantly to cost.

Another development combines aspects of SAGD and VAPEX. In Expanding Solvent-SAGD (ES-SAGD), steam and solvent are co-injected. During the ES-SAGD process, a small amount of solvent with boiling temperature close to the steam temperature under operating conditions is co-injected with steam in a vapor phase in a gravity process similar to the SAGD process. The solvent condenses with steam at the boundary of the steam chamber. The condensed solvent dilutes the oil and reduces its viscosity in conjunction with heat from the condensed steam. This process offers higher oil production rates and recovery with less energy and water consumption than those for the SAGD process, and less solvent usage that VAPEX. Experiments conducted with two-dimensional models for Cold Lake-type live oil showed improved oil recovery and rate, enhanced non-condensable gas production, lower residual oil saturation, and faster lateral advancement of heated zones (Nasr and Ayodele, 2006). A solvent assisted SAGD is shown in FIG. 3 and is described in U.S. Pat. Nos. 6,230,814 and 6,591,908. It has been shown that combining solvent dilution and heat reduces oil viscosity much more effectively than using heat alone.

It is proposed that as the solvent condenses, the viscosity of the hydrocarbons at the steam-hydrocarbon interface decrease. As the steam front advances, further heating the reservoir, the condensed solvent evaporates, and the condensation-evaporation mechanism provides an additional driving force due to the expanded volume of the solvent as a result of the phase change. It is further believed that the combination of reduced viscosity and the condensation-evaporation driving force increase mobility of the hydrocarbons to the producing well.

Because of the cost of the injected solvents, they are usually recovered and recycled. Typically, the solvents are recovered by injecting steam back into the formation to vaporize the solvents and drive them out for recovery. One feature of the ES-SAGD process is that the recovered solvent can be re-injected into the reservoir. The economics of a steam-solvent injection process depends on the enhancement of oil recovery as well as solvent recovery. The lower the solvent retention in the reservoir the better the economics of the process.

There are three major factors that could affect production: gravity and viscous flow, heat conduction, and mass diffusion and dispersion. In any event, sufficient heat and solvent need to be introduced to the bitumen at a rate that is both economically and physically feasible, thereby mobilizing the bitumen to the production well.

Therefore, there is the need to find the optimal strategy for when and how to introduce solvent for ES-SAGD process to reduce solvent retention in the reservoir and improve economics of the process.

SUMMARY OF THE DISCLOSURE

The ES-SAGD process is an improvement of the SAGD process and has been recently applied in the field. In the ES-SAGD process, a small amount of solvent or a solvent mixture is added to the injected steam, but the degree of solvent retention in the reservoir impacts process economics. A new methodology is developed herein to reduce the solvent retention during the solvent injection in the ES-SAGD process.

Generally speaking, the invention hinges on the use of a steam-solvent mixture of about 10-25 v % solvent concentration, wherein the solvent composition is at least 40 v % C5+. Using this particular mixture solvent retention is reduced (see FIG. 4), and at the same time recovery improves significantly (see FIG. 5).

In one embodiment, a method is provided for recovering hydrocarbons while reducing the solvent retention in the reservoir. At least an injection well and a production well are provided that communicate with the hydrocarbon reservoir, where the injection well is typically (but not necessarily) located above the production well. A heated fluid composition is injected through the injection well, and the heated fluid composition comprises steam and solvent, the solvent being mostly C5+ hydrocarbons. The heated fluid composition thereby reduces the viscosity of the hydrocarbons, which are then produced through the producing well. By adjusting the ratio of solvent to steam in the heated fluid composition and/or by changing the composition of the solvent, an almost 25% reduction in solvent retention can be achieved. Furthermore, the oil production can be increased also by almost 25%.

In one embodiment, the heated fluid concentration comprises at least 10% liquid volume (v %) of solvent, including 15 v %, preferably 20 v %, and more preferably up to 25 v %, with the majority of the remainder being steam.

In one embodiment, the solvent composition comprises at least about 40 v % liquid volume of C5+ hydrocarbons, preferably at least about 50 v %, 60 v %, 70 v %, 80 v %, 85 v %, 90 v %, or 95 v % or more with the remainder being mostly lighter hydrocarbons including C3-C4.

In one embodiment of the invention, the heated fluid mixture may be injected into an injection well by first mixing the steam and solvent, preferably in the gas phase, prior to injection.

In another embodiment, separate lines for steam and solvent can be used to independently, but concurrently, introduce steam and solvent into the injection well, where the steam and solvent will mix. A separate solvent injection is particularly suitable for retrofitting existing well-pad equipment. Also, it may be easier to monitor the solvent flow rate, where separate steam and solvent lines are used to inject the heated fluid composition.

In another embodiment, steam injections may be alternated with the steam/solvent co-injection.

In a typical SAGD process, initial thermal communication between an injection well and a producing well is established by injection of steam and/or low viscosity hydrocarbon solvent into one of the wells until thermal communication is achieved, as indicated by oil production, but other methods can be used, including $CO_2$ flood, in situ combustion, EM heating methods, and the like. In the alternative, a combination of these methods may be employed.

In reservoirs where communication between an injection well and a producing well is already established, the inventive ES-SAGD process can be implemented immediately by injecting the specified steam-solvent mixture into the injection well. As the steam and solvent condense, hydrocarbons are mobilized by the heat from the condensing steam and dilution of the hydrocarbons by condensing solvent and drain by gravity to the producing well. In a preferred embodiment, the injection and producing wells are superposed horizontal wells, spaced about 5 meters vertically apart, near the bottom of the formation, but this is not a requirement.

Novel well configurations can also be used, such as the fish-bone wells and radial wells, recently described in patent applications by ConocoPhillips. In these variations, the wells are not vertically paired as in traditional SAGD, but nonetheless the wells are positioned to allow gravity drainage and they can be considered SAGD variants. See US 2014-0345855 A1 titled "Radial Fishbone SAGD," filed Mar. 27, 2014, and US 2014-0345861 A1, titled "Fishbone SAGD," filed Feb. 5, 2014.

The term "fluid" as used herein refers to both vaporized and liquefied fluid in the sense that it is capable of flowing.

The term "steam" as used herein refers to water vapor or a combination of liquid water and water vapor. It is understood by those skilled in the art that steam may additionally contain trace elements, gases other than water vapor and/or other impurities. The temperature of steam can be in the range of from about 150° C. to about 350° C. However, the required steam temperature is dependent on the operating pressure, which may range from about 100 psi to about 2,000 psi (about 690 kPa to about 13.8 MPa), as well as on the in situ hydrocarbon characteristics and ambient temperatures.

The term "co-injection" as used herein means the two materials are introduced at the same time, using a single mixed fluid stream or two separate fluid streams.

The term "solvent" as used herein refers to a fluid that has at least one non-aqueous fluid. Examples of suitable candidates for non-aqueous fluids that may be used include but not limited to C1 to C30 hydrocarbons, and combinations thereof, and more preferably to C2 to C10 hydrocarbons. The preferred hydrocarbons herein include C5-C9. Examples of suitable hydrocarbons include but not limited to pentanes, hexanes, heptanes, octanes, nonanes, decanes, undecanes, dodecanes, tridecanes, tetradecanes, linear and cyclic paraffins, diluent, kerosene, light and heavy naphtha and combinations thereof.

Solvent composition refers to the composition of the solvent. The term "C5+" hydrocarbons as used herein means that the majority of the hydrocarbons have at least 5 carbons, but 100% purity is not required. C5+ includes a composition of C5-C12 hydrocarbons, but may include a C5-C9 or C5-C8 composition. There may also be trace amounts of other solvents and materials in a solvent composition. Any solvent composition may be purchased commercially where the composition of the solvent may range from 40-95% of the major solvent with a variety of other solvents. In one embodiment a C5+ solvent is used that contains 40 v % C5-C12 hydrocarbons with added pentane, heptane, octane, and/or additional solvents. Additional solvents may be added to modify solvent properties.

Solvent Concentration refers to the concentration of solvent to steam. Solvent concentrations may vary from 10 v % solvent/90 v % steam to 25 v % solvent/75 v % steam. In one embodiment solvent is used at a solvent concentration of about 15 v % solvent/85 v % steam. In another embodiment solvent is used concentration of about 20 v % solvent/80 v % steam.

It will be understood by those skilled in the art that the operating pressure may change during operation. Because the operating pressure affects the steam temperature, the solvent may be changed during operation so that the solvent evaporation is within the desired range of the steam temperature.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| SAGD | Steam assisted gravity drainage |
| ES-SAGD | Expanding solvent-SAGD |
| C5+ hydrocarbon | Hydrocarbon molecule with five or more carbon atoms |
| VAPEX | Vapor extraction |
| v % | volume percent |

DETAILED DESCRIPTION

Figure 1:
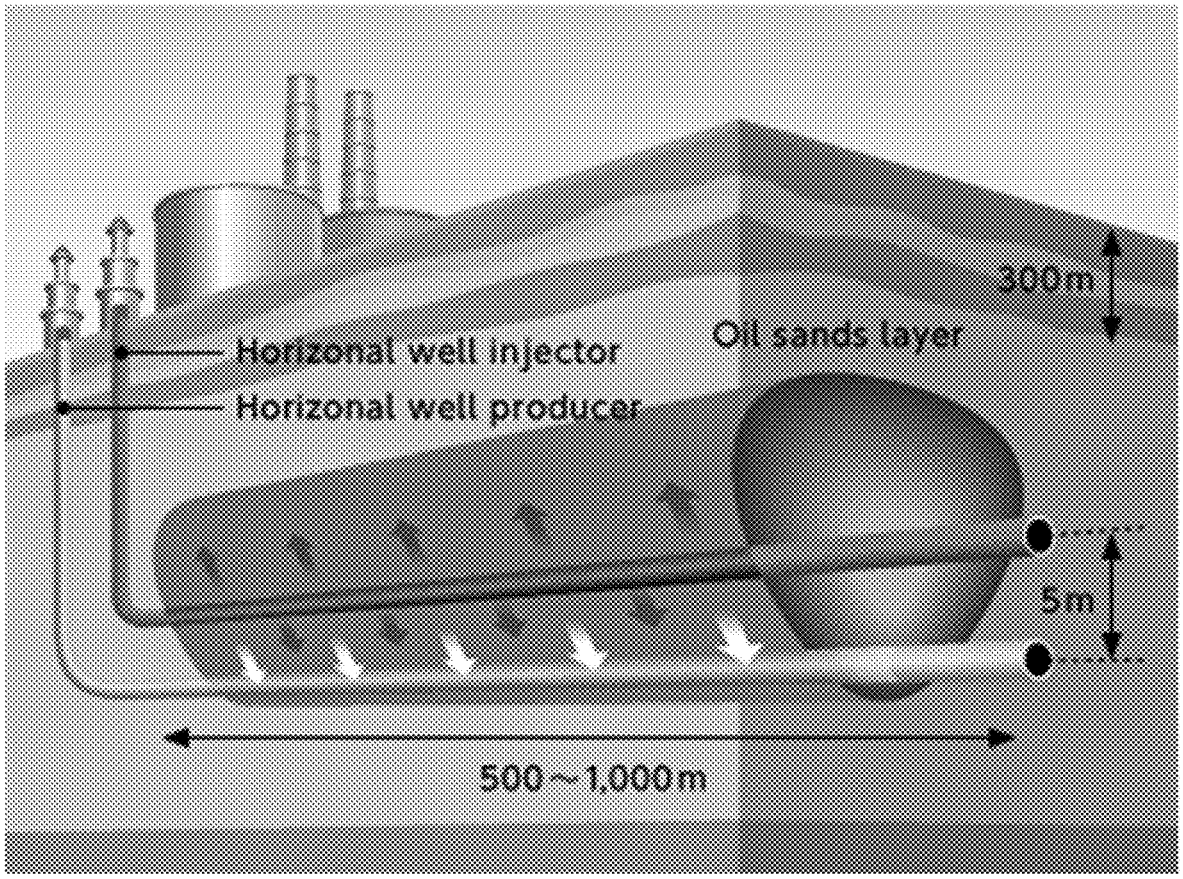
FIGURE 1 (PRIOR ART)
FIG. 1 shows a conventional SAGD well pair.
Figure 2:
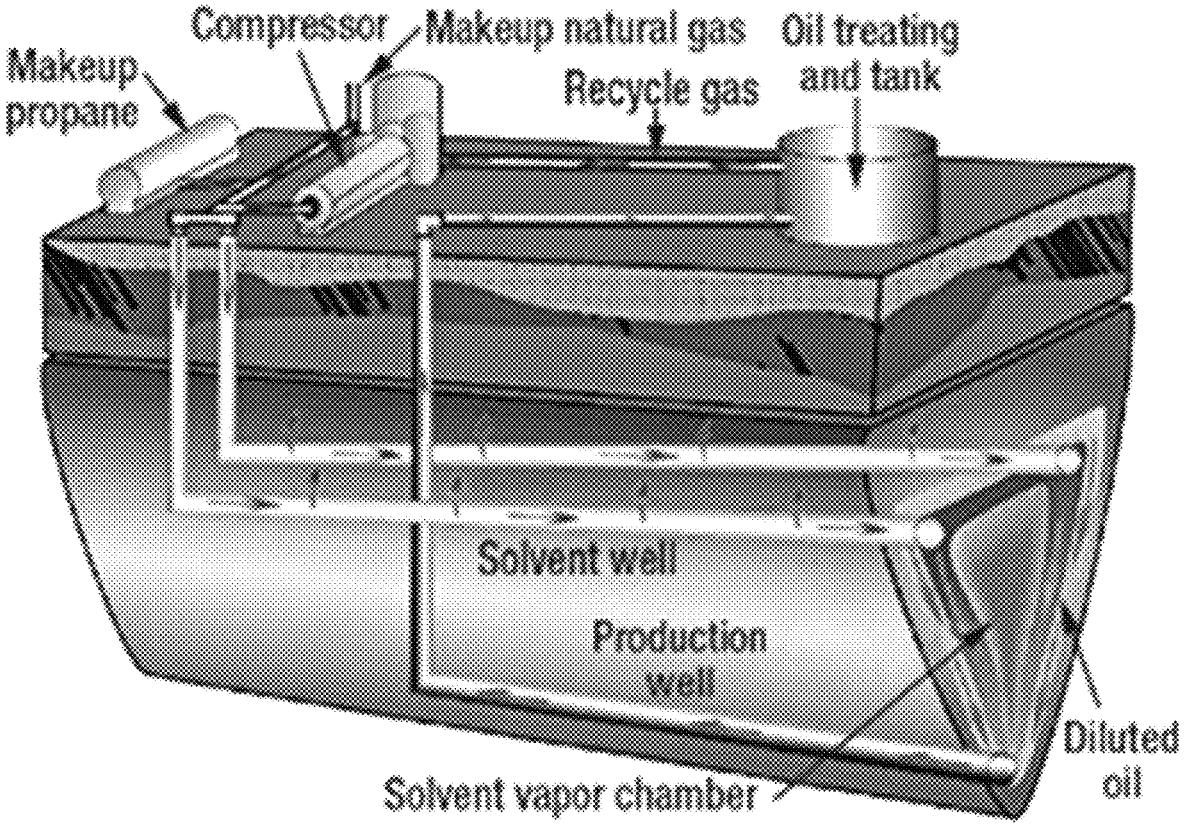
FIGURE 2 (PRIOR ART)
FIG. 2 shows a typical VAPEX process.
Figure 3:
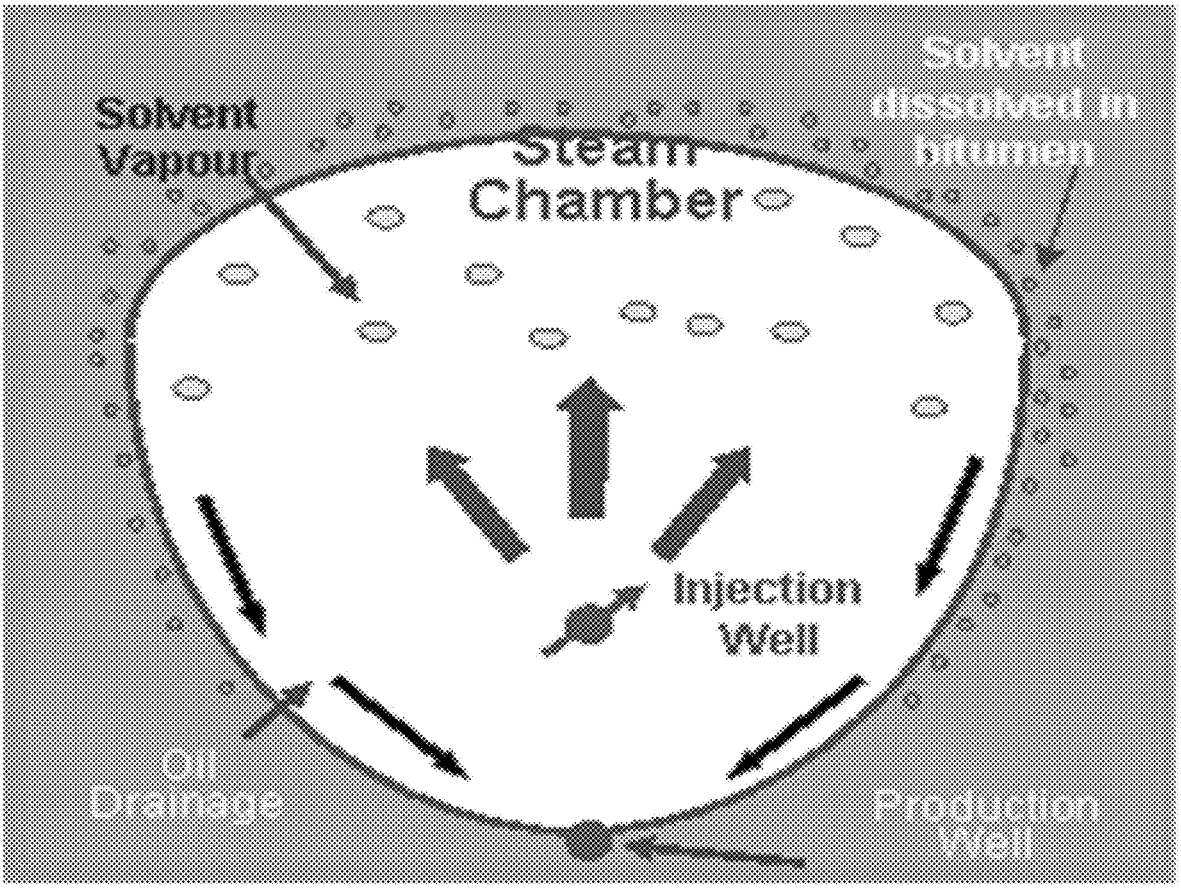
FIG. 3 shows an ES-SAGD process that can be used in the invention.

The disclosure provides novel method for producing hydrocarbons from a subterranean formation that has at least one injection well and at least one producing well that can communicate with at least a portion of the formation. The producing well is used for collecting the hydrocarbons, and the injection well is used for injecting a heated fluid composition comprising steam and a solvent. The method comprises the following steps: a) selecting the solvent; b) making the heated fluid composition from the steam and solvent; c) injecting the heated fluid composition into the formation; d) heating the hydrocarbons in the formation using the heated fluid composition; and e) collecting the hydrocarbons; wherein the solvent comprises at least 40 v % liquid of C5+ hydrocarbon solvents.

In another aspect of this invention, there is provided a method of producing hydrocarbons from a subterranean formation that has at least one injection well and at least one producing well that can communicate with at least a portion of the formation, the producing well being used for collecting the hydrocarbons, and the injection well being used for injecting a heated fluid composition comprising steam and a solvent, the method comprising: a) selecting at least one solvent; b) making the heated fluid composition from the steam and the solvent; c) injecting the heated fluid composition into the formation; d) heating the hydrocarbons in the formation using the fluid composition; and e) collecting the hydrocarbons; wherein the heated fluid composition comprises at least 10 v % of the solvent.

By adjusting the concentration and composition of the hydrocarbon solvents, one skilled in the art can optimize the best injection strategies that have better recovery economics and overall oil production.

The disclosure includes one or more of the following embodiments, in various combinations:

A method of producing hydrocarbons from a subterranean formation that has at least one injection well and at least one producing well that can communicate with at least a portion of said formation, and said injection well being in fluid communication with said production well, the method comprising co-injecting a fluid comprising steam and solvent into said injection well, wherein said solvent comprises at least 40 v % of C5+ hydrocarbon; and producing said hydrocarbons from said production well.

In some embodiments fluid concentration may be mixtures containing at least 10 v %, 15 v %, 20 v % or 25 v % solvent.

In another embodiment, solvent compositions may containing at least 40 v %, 45 v %, 50 v %, 55 v %, 60 v %, 65 v %, 70 v %, 75 v %, 80 v %, 85% or 90 v % by volume of C5+ hydrocarbon solvents.

In other embodiments, solvent can be recaptured from the produced hydrocarbons, and reused in the co-injection step.

The method can be used in traditional ES-SAGD operations, but can be applied to the many variations of steam-based techniques as well. The method can also be applied to novel well configurations, and not just traditional SAGD well pairs.

The method can be preceded by steam injection or followed by steam injection. It can also be combined with other enhanced oil recovery techniques.

Another embodiment is a method of producing hydrocarbons from a subterranean reservoir having one or more injections well and one or more production wells in fluid communication with said reservoir, the method comprising co-injecting a fluid comprising steam and solvent into said one or more injection wells for a time sufficient to mobilize hydrocarbons; and producing said mobilized hydrocarbons from said one or more production wells; wherein said fluid comprises about 25 v % liquid of said solvent.

Also provided are improved methods of ES-SAGD, comprising co-injecting steam and solvent into an injection well and producing oil at a production well, the improvement comprising co-injecting about 75 v % steam and about 25 v % solvent, wherein said solvent is until at least 95 v % C5+ hydrocarbons.

Another improved method of ES-SAGD comprises co-injecting steam and solvent into an injection well and producing oil at a production well, the improvement comprising co-injecting about 75 v % steam and about 25 v % solvent, wherein solvent retention is reduced as compared with using lesser amounts of solvent.

Another improved method of ES-SAGD comprises co-injecting steam and solvent into an injection well and producing oil at a production well, the improvement comprising co-injecting about steam and a solvent comprising at least 40 v % C5+, wherein cumulative oil production is increased as compared with using lesser amounts of C5+ solvent.

Another improved method of ES-SAGD comprises co-injecting steam and solvent into an injection well and producing oil at a production well, the improvement comprising co-injecting about 80 v % steam and about 20 v % solvent, wherein said solvent is at least 60 v % C5+ hydrocarbons.

Experiment 1

A 3D heterogeneous field scale numerical model, based on Athabasca reservoir and fluid properties, was used to examine strategies for reducing solvent retention in the reservoir. The commercial thermal reservoir simulator STARS, developed by Computer Modeling Group (CMG), was used in the numerical simulation.

The simulated reservoir was 132 meters (m) wide and 44 m thick. Two horizontal wells, 950 m long and separated by 5 m, were modeled. A pre-heat period was used by circulating steam in both wells for a period of time, similar to field pre-heat. Following the pre-heat, steam plus solvent (ES-SAGD) was injected into the top well at a pressure of 3500 kPa for simulated period of 4.5 years. The solvent used was a mixture of different hydrocarbons, C3 to C5+ (different solvent to steam ratios were evaluated).

Following a period of steam-solvent injection at 3500 kPa, a steam-only injection (SAGD) was used and the injection pressure was lowered to 2200 kPa for 5 years. The pressure was further reduced to 1600 kPa and steam injection continued for 6.5 years. Finally, the process was concluded by a shut-in of the injection well and continued production for another 4.5 years.

It was found that the solvent retention in the reservoir at the end of the solvent injection period depends on a combination of different variables including solvent injection duration, solvent concentration in steam and composition of the solvent used. The following ranges of variables were investigated. Solvent injection duration between 1 and 4.5 years, solvent concentration between 10 and 25 v % and solvent composition was changed by increasing the heavier solvent components (C5+) between 33 to 95 v % in the injected solvent mixture.

A combination of these variables was discovered that resulted in reduced solvent retention in the reservoir and increased oil production, when a mixture of hydrocarbons was used. This combination includes injecting the solvent up to 4.5 years at a concentration of 25 v % and using a solvent composition that contains between 40 to 95 v % C5+. As C5+ increased in the solvent mixture beyond 85 v %, the performance improved.

Figure 4:
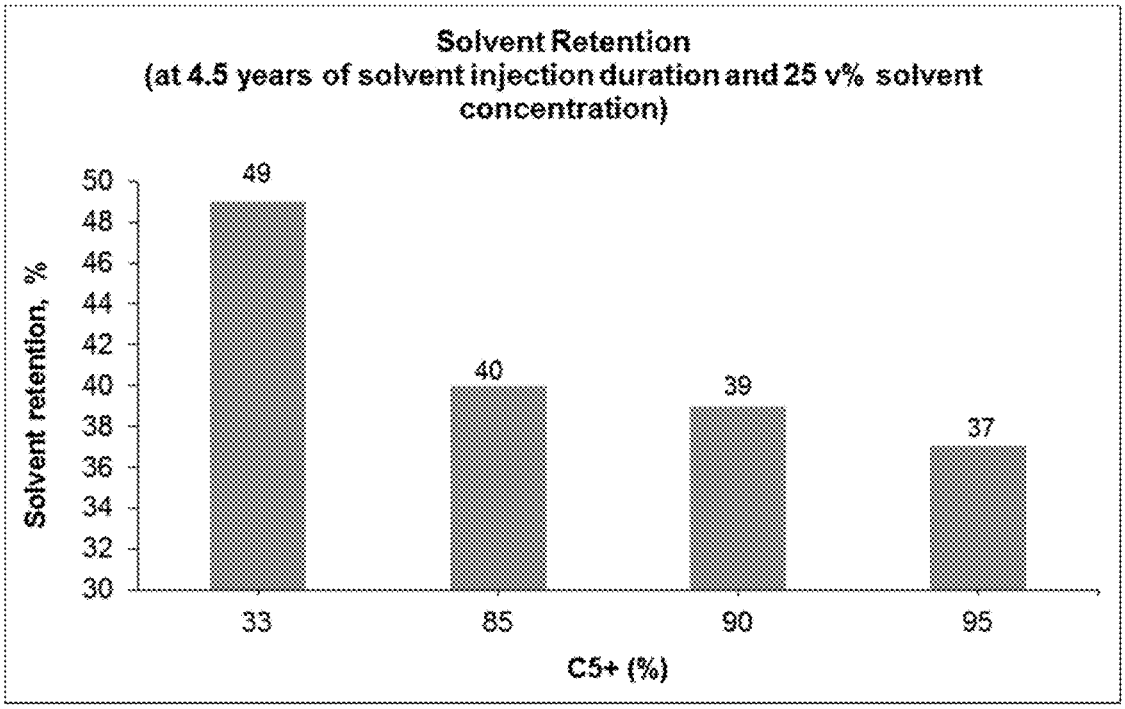
FIG. 4 shows the results of a simulation for solvent retention comparison.

In terms of solvent retention, FIG. 4 shows the simulation result of solvent retention at the end of the solvent injection period (%, amount of solvent remaining in reservoir/amount of solvent injected) versus different concentrations of C5+ components in the injected solvent. As shown in FIG. 4, the identified injection strategy resulted in lower solvent retention. For example, when the injected organic solvents comprise only 33 v % of C5+ components, the projected solvent retention was 49%. When the injected organic solvents compositions comprise 85 v % of C5+ components, the projected solvent retention was reduced to 40%. As the injected organic solvents compositions further increased to 95 v % of C5+ component, the solvent retention further reduced to 37%. This represents almost 25% reduction in solvent retention compared to the 49% when C5+ composition was only 33 v %.

Figure 5:
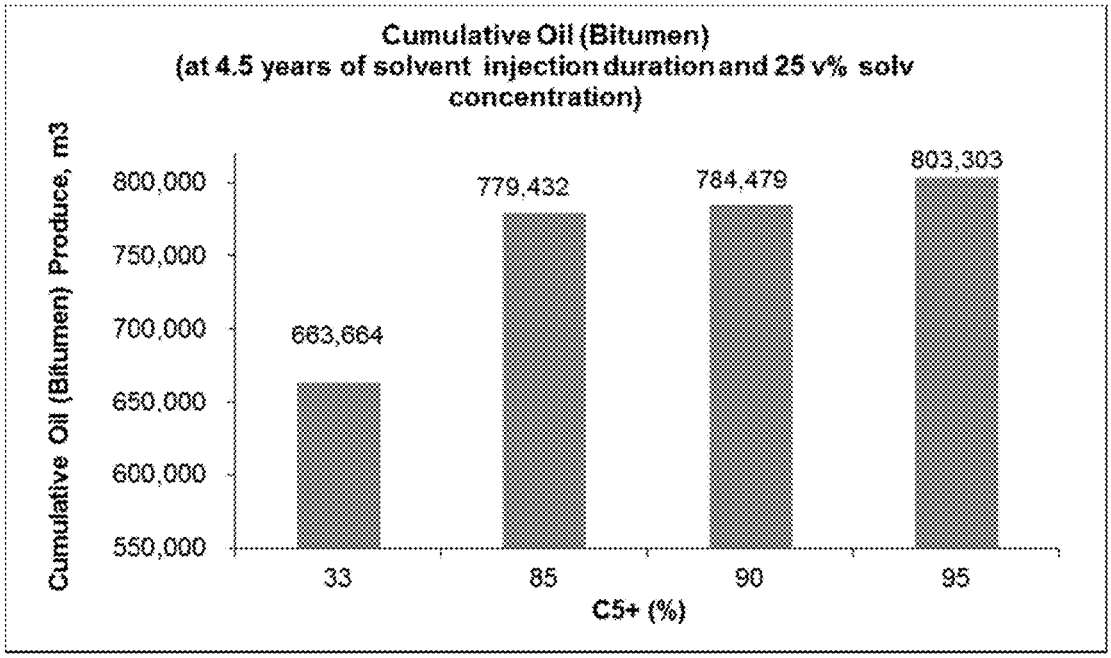
FIG. 5 shows the results of a simulation for cumulative oil production comparisons.

FIG. 5 shows the simulation result of cumulative oil production versus different concentration of C5+ components in the injected solvents. As shown in FIG. 5, the projected cumulative oil production is roughly 663,664 $m^3$ when the composition of C5+ component is 33 v %. The cumulative oil production increases to 779,432 $m^3$ when the concentration of C5+ component is increased to 85 v %. The cumulative oil production further increases to 803,303 $m^3$ when the concentration of C5+ component is further raised to 95 v %. This represents a 21% increase in oil production.

As an example, the percentage of injected solvent retained in the reservoir was calculated at the end of 4.5 years of solvent injection and just before the time when SAGD was initiated. The identified operating strategy for the ES-SAGD process can result in better economics and significant performance improvements over that from SAGD and better exploitation of heavy oil and oil sand reservoirs.

Figure 6:
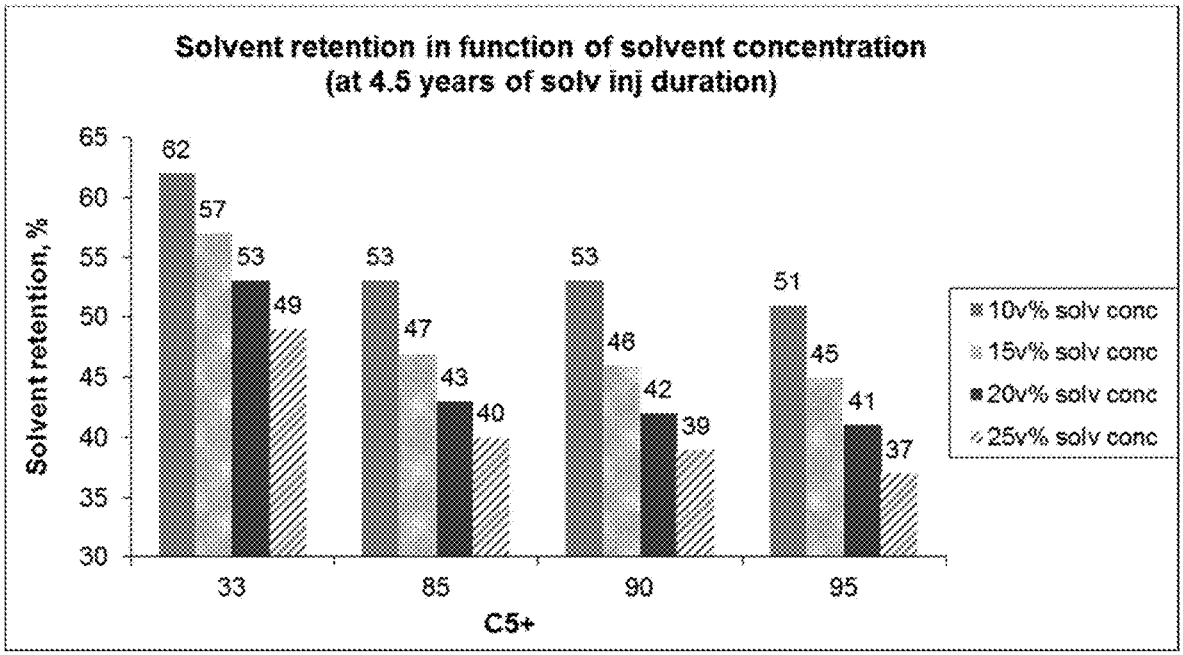
FIG. 6 displays the results of a simulation for cumulative solvent retention at the end of the solvent injection period when different solvent compositions are used with the concentration of the steam/solvent mixture injected is increased from 10 v % to 25 v %.

Additionally, the total amount of solvents in the steam/solvents mixture can also be optimized to achieve better economics than SAGD alone. FIG. 6 displays the expected solvent retention in the reservoir for various concentrations of C5+ hydrocarbons and various total solvent concentrations in the steam. For example, this invention envisions that when the total amount of solvents reaches 25 v % of the steam/solvent mixture injected, the solvent retention is further reduced compared to when the total amount of solvent is only 10 v % or 15 v % of the steam/solvent mixture, as seen in FIG. 6. Additionally, higher concentrations of C5+ hydrocarbons also result in lower solvent retention. However, the lower solvent retention seems to level off with solvent compositions between 85-90 v % C5+ hydrocarbons, thus suggesting that a smaller, and less costly, amount of C5+ can be used to achieve approximately the same retention results.

Figure 7:
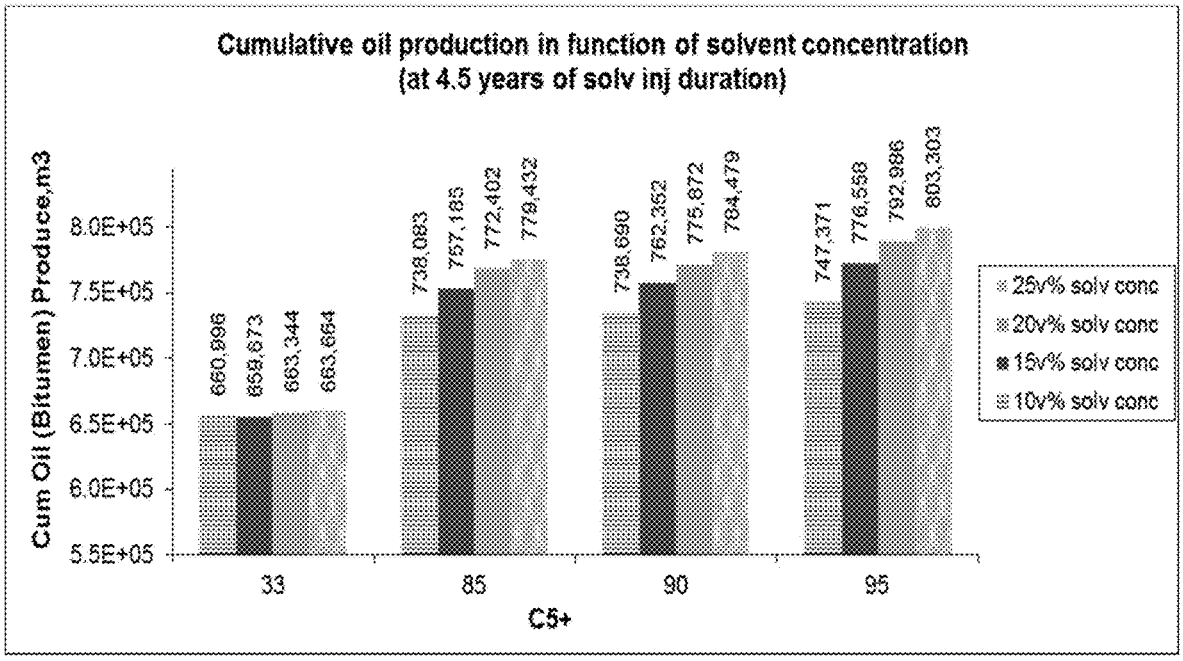
FIG. 7 shows the results of a simulation for cumulative oil production at the end of the solvent injection period when different solvent compositions are used with the concentration of the steam/solvent mixture injected is increased from 10 v % to 25 v %.

Additionally, the oil production for different steam/solvent mixtures can be optimized to achieve better economics than SAGD alone. FIG. 7 shows a comparison of the cumulative oil production for the same solvents in FIG. 6. For example, this invention envisions that when the total amount of solvents reaches 25 v % of the steam/solvent mixture injected, the oil production is further increased comparing to when the total amount of solvent is only 10 v % or 15 v % of the steam/solvent mixture.

This invention thus provides different injection strategies that can significantly reduce solvent retention and improve oil production by altering the hydrocarbon solvents concentration and composition.

The following are incorporated by reference herein in their entireties:

1) Nasr, T. N., Golbeck, H. and Heck, G.: 2003, Novel expanding solvent-SAGD process "ES-SAGD", Journal of Canadian Petroleum Technology 42(1), 13-16.
2) Nasr, T. N. and Ayodele, O. R.: 2006, New hybrid steam-solvent processes for the recovery of heavy oil and bitumen, paper SPE 101717 presented at the SPE Abu Dhaba International Petroleum Exhibition and Conference, Abu Dhabi. 5-8 November.
3) U.S. Pat. Nos. 6,230,814, 6,591,908, Nasr & Isaacs, "Process for enhancing hydrocarbon mobility using a steam additive," Alberta Oil Sands, (1999).

4) US 2014-0345855 A1, titled "Radial Fishbone SAGD," filed Mar. 27, 2014.
5) US 2014-0144627 A1, titled "Hydrocarbon Recovery with Steam and Solvent Stages," filed Nov. 14, 2013.
6) US 2014-0345861 A1, titled "Fishbone SAGD," filed Feb. 5, 2014.

What is claimed is:

1. A method of producing hydrocarbons from a subterranean formation that has at least one injection well and at least one producing well that can communicate with at least a portion of said formation, and said injection well being in fluid communication with said production well, the method being an Expanding Solvent-Steam-Assisted Gravity Drainage (ES-SAGD) and SAGD combination consisting essentially of:

a) co-injecting a fluid comprising 75% steam and 25% solvent at a first pressure into said injection well for a first period of time of approximately 4.5 years, wherein said solvent comprises a mixture with between 85 and 95 v % of C5 to C12 hydrocarbons;
b) co-producing said hydrocarbons and said solvent from said production well;
c) recapturing said solvent that is co-produced along with said hydrocarbons, and recycling said recaptured solvent in step a); and,
d) injecting steam only into the injection well at a second pressure for a second period of time after said first period of time and producing said hydrocarbons from said production well,
wherein said second pressure is lower than said first pressure.

2. The method of claim 1, wherein said solvent is selected from the group consisting of C5 to C9 hydrocarbons.

3. The method of claim 1, wherein said solvent is selected from the group consisting of pentanes, hexanes, heptanes, octanes, nonanes and combinations thereof.

4. The method of claim 1, further comprising:

e) injecting steam into said injection well at a third pressure for a third period of time after said second period of time.

5. A method of producing hydrocarbons from a subterranean reservoir having one or more injection wells and one or more production wells in fluid communication with said reservoir, the method being an Expanding Solvent-Steam-Assisted Gravity Drainage (ES-SAGD) consisting essentially of:

a) co-injecting a fluid comprising 90% liquid volume steam and 10% liquid volume of solvent into said one or more injection wells for approximately 4.5 years wherein said solvent comprises a solvent mixture with between 85 and 95 v % C5 to C12 hydrocarbons;
b) co-producing mobilized hydrocarbons and said solvent from said one or more production wells; and,
c) recapturing said solvent that is co-produced along with said mobilized hydrocarbons, and recycling said recaptured solvent in step a).

6. An improved method of Expanding Solvent-Steam-Assisted Gravity Drainage (ES-SAGD), said method comprising co-injecting steam and solvent into an injection well and producing oil at a production well, the improvement consisting essentially of:

a) co-injecting about 75 v % steam and about 25 v % solvent for about 4.5 years;
b) producing a hydrocarbon and solvent and water mixture at said production well; and,
c) recapturing said solvent from said mixture and recycling said recaptured solvent in step a),
wherein said solvent comprises a solvent mixture with between 85 and 95 v % C5 to C12 hydrocarbons, and
wherein solvent retention is reduced as compared with using lesser amounts of solvent.

7. An improved method of Expanding Solvent-Steam-Assisted Gravity Drainage (ES-SAGD), said method comprising co-injecting steam and solvent into an injection well and producing oil at a production well, the improvement consisting essentially of:

a) co-injecting 75-90% steam and a 10-25% solvent mixture with between 85 and 95 v % C5 to C12 for 1 to 4.5 years;
b) co-producing an oil and solvent mixture; and,
c) recapturing said solvent mixture from said co-produced aft oil and solvent mixture and using said recaptured solvent in step a),
wherein a cumulative oil production is increased as compared with using lesser amounts of C5 to C12.

8. An improved method of Expanding Solvent-Steam-Assisted Gravity Drainage (ES-SAGD), said method comprising co-injecting steam and solvent into an injection well and producing oil at a production well, the improvement consisting essentially of:

a) co-injecting about 80 v % steam and about 20 v % solvent;
b) co-producing an oil and solvent mixture; and,
c) recapturing said solvent from said mixture and reusing said recaptured solvent in step a);
wherein said solvent is a mixture with between 85 and 95 v % C5 to C12 hydrocarbons.

* * * * *